US006402891B1

(12) United States Patent
Asher et al.

(10) Patent No.: US 6,402,891 B1
(45) Date of Patent: Jun. 11, 2002

(54) SYSTEM FOR CLEANING AN APPARATUS

(75) Inventors: Vikram Vithaldas Asher, Cincinnati; Edward Robert Bowden, Hamilton, both of OH (US)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/779,070

(22) Filed: Feb. 8, 2001

(51) Int. Cl.[7] ..... D21F 1/32

(52) U.S. Cl. ..... 162/199; 162/272; 134/122 R; 134/198; 134/9

(58) Field of Search ..... 162/199, 272, 162/274, 275, 276, 277, 278, 279, DIG. 4, 158; 159/48.1, 48.2; 239/532, DIG. 17, DIG. 19–87; 134/15, 68, 72, 122 R, 32, 198, 40, 42, 9

(56) References Cited

U.S. PATENT DOCUMENTS

| | | | | |
|---|---|---|---|---|
| 5,034,094 A | | 7/1991 | Kurple | |
| 5,120,532 A | | 6/1992 | Wells et al. | |
| 5,705,470 A | | 1/1998 | Faris | |
| 5,885,419 A | | 3/1999 | Nguyen et al. | |
| 5,977,050 A | * | 11/1999 | Faris | 510/403 |

OTHER PUBLICATIONS

Aerosols and Pressure: www.schoolscience.com.uk/content/4/physics/bama/aerosch3pg3.html.*

* cited by examiner

*Primary Examiner*—Peter Chin
*Assistant Examiner*—Eric Hug
(74) *Attorney, Agent, or Firm*—Edward A. Squillante, Jr.

(57) ABSTRACT

The invention is directed to a system for cleaning an apparatus like a paper making apparatus. The system sprays a thickened liquid composition that has a soil treating agent, and the system may be used at pressures which do not exceed 100 psi.

10 Claims, 2 Drawing Sheets

SYSTEM FOR CLEANING AN APPARATUS

FIELD OF THE INVENTION

This invention is directed to a system for cleaning an apparatus. More particularly, the invention is directed to a system for cleaning an apparatus whereby the system comprises a nozzle assembly with the capacity to spray a thickened liquid composition. The thickened liquid composition may comprise a soil treating agent and surfactant and can be used to clean a variety of apparatuses, including paper making machines.

BACKGROUND OF THE INVENTION

The deposition of contaminants in and on equipment such as boilers, cooling towers, food and beverage equipment, and pulp and paper processing equipment, can be detrimental to the efficiency of the various processes being conducted in the equipment. Moreover, the desired products generated from contaminated equipment typically display properties and characteristics that are inferior to products made in a contaminant-free environment.

In the pulp and paper industries, for example, internal and external components of equipment, such as equipment used during the dry-and wet-ends of the paper making process, are subjected to various inorganics as part of the processing steps to convert pulp into paper. During such a process, diluted pulp (i.e., pulp which is about 99% water) is distributed onto fast-moving screens where it begins to take the form of paper. Subsequent to distribution on the screens, water is removed from the pulp via gravity and vacuum pumps strategically placed about the apparatus. The resulting damp paper sheets are then pressed between felt blankets to remove additional moisture. The dried paper then moves from the felt blankets to heated cylinders of the paper making pulping apparatus so that the final paper product does not exceed about 6.0% water. Finally, the resulting final paper product may be subjected to a smoothing step before being rolled and shipped to customers.

As can be understood, the paper making process, like many other processes, is complicated. This is true because precursor paper raw materials are typically subjected to harsh environments that comprise many chemical and physical processing steps. Such chemical processing steps are known to generate a fair amount of waste and contaminants, and the apparatuses involved with these steps require cleaning to ensure that superior and contaminant-free product is being generated.

Conventional methods for cleaning internal and external portions of equipment, such as those described above, typically employ high volumes of solution and active that dissolve the contaminants associated with the equipment. The solution method, however, has many disadvantages, including the generation of excess environmentally unfriendly waste that typically has to be removed to off-site hazardous waste plants. Other conventional methods for removing contaminants from the internal and external portions of equipment include the use of high pressure water blasting (e.g., blasting at pressures that exceed at least 400 psi). Such a water blasting method, unfortunately, requires the expensive and labor-intensive steps of disconnecting the parts of the equipment prior to cleaning. Moreover, water blasting techniques are not very safe because the chemical solutions employed often splash onto the individuals conducting the high pressure water blasting.

In addition to the vast deficiencies of the conventional methods outlined above, such conventional methods require that the cleaning solutions be mixed and/or processed at a job site prior to use. Also, such conventional methods typically use cleaning solutions having about 50% by weight more active than the thickened liquid composition of the present invention.

It is of increasing interest to develop a system for cleaning apparatuses. More particularly, it is of increasing interests to develop a system that does not generate excess hazardous waste, can be conducted at low pressures and is safe to use. This invention, therefore, is directed to a system for cleaning an apparatus that does not generate excess hazardous waste, is conducted at pressures under about 100 psi is safe, and does not require processing of a chemical solution before use at job sites.

BACKGROUND REFERENCES

Efforts have been disclosed for cleaning in U.S. Pat. Nos. 5,977,050 and 5,705,470 cleaning gels that are dispensed from a hand held trigger or aerosol spray applicator.

Other efforts have been disclosed for inhibiting contaminant deposition in papermaking systems. In U.S. Pat. No. 5,885,419, the deposition of organic contaminants in a paper making system is minimized by adding albumins, globulins and spray-dried animal cells to the pulp, or by spraying deposition prone surfaces of the paper making system with the same.

Still additional efforts have been disclosed that convert inorganic materials in Kraft pulping liquor into pulping chemicals. In U.S. Pat. No. 5,034,094, pulp recovery is increased by separating organics and inorganics wherein the former is recycled to a process loop and the latter is converted into pulping chemicals without the need of a recovery furnace.

SUMMARY OF THE INVENTION

In a first aspect, the present invention is directed to a system for cleaning apparatus, the system comprising:

(i) a thickened liquid composition comprising a viscosity from about 50.0 cps to about 1,000 cps;

(ii) a spraying device comprising at least one orifice having a diameter from about $2.0\times10^{-2}$ cm at about $6.5\times10^{-1}$ cm; and (iii) a pressure source supplying less than about 100 psi of pressure wherein the thickened liquid composition comprises components that clean soil on the apparatus.

In a second aspect the present invention is directed to a kit comprising:

(a) a thickened liquid composition comprising a viscosity from about 50.0 cps to about 1,000 cps, the liquid composition comprising components that clean soil on the apparatus;

(b) a spraying device comprising at least one orifice having a diameter from about $2.0\times10^{-2}$ cm at about $6.5\times10^{-1}$ cm; and (c) a pressure source supplying less than about 100 psi of pressure; and (d) instructions to use the liquid composition supplied is and at a pressure that does not exceed about 100 psi.

In a third aspect, this invention is directed to a method for cleaning an apparatus with the system described in the first aspect of this invention.

Thickened liquid composition, as used herein, is defined to mean a liquid having a viscosity of greater than about 50 cps and less than about 1000 cps (at ambient temperature and taken with a Brookfield Viscometer, spindle No. 2), and soil treating agent is defined to mean a substance that can react with, neutralize and/or dissolve soil. Pressure less than about 100 psi generally means pressures from about 5 psi to about 99.99 psi, and preferably, form about 40 psi to about 80 psi, including all ranges subsumed therein.

BRIEF DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE PREFERRED EMBODIMENTS

Figure 1:
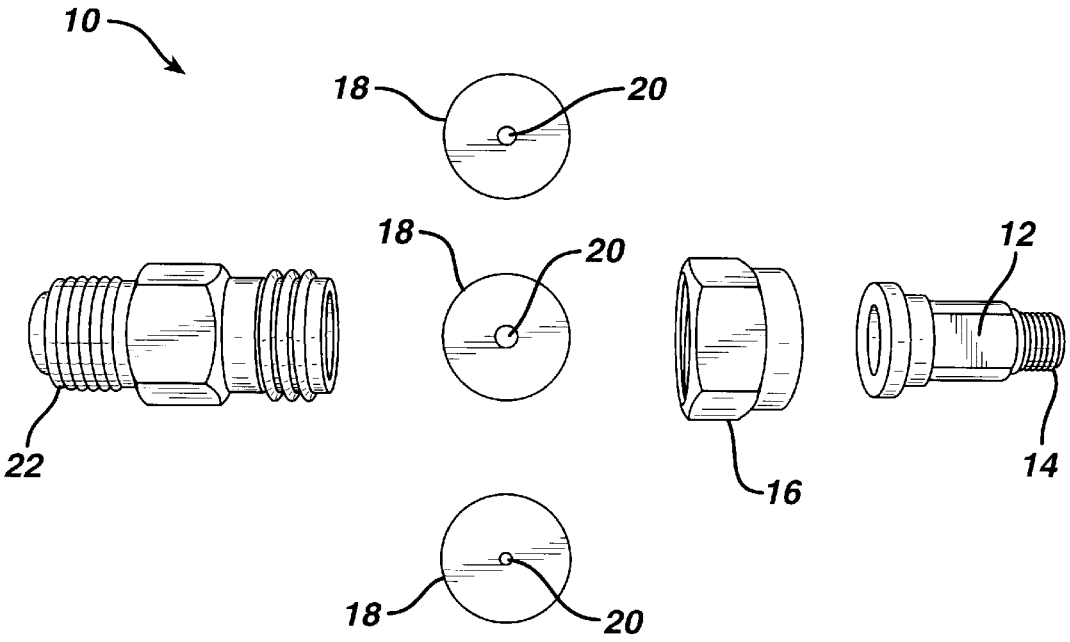
FIG. 1 represents a type of spray nozzle that may be used in the system of this invention.

There is no limitation with respect to the type of thickened liquid composition that may be used in this invention as long as the thickened liquid composition can be used to remove a particular soil targeted for disposal. In the present invention, the thickened liquid composition typically has a viscosity of greater than about 50 cps and less than about 1000 cps; and preferably, greater than about 65 cps and less than about 700 cps; and most preferably, greater than about 75 cps and less than about 450 cps, including all ranges subsumed therein.

An illustrative example of the type of thickened liquid which may be used in this invention includes one comprising water, surfactant, a thickening agent and a soil treating agent like an acid or a base.

The surfactants which may be used in the thickened liquid composition that may be used in this invention include anionic, cationic, nonionic, zwitterionic, and amphoteric surfactants or a mixture thereof. The surfactants are known in the art and commercially available from suppliers like Shell Chemical, Witco Chemical Company, Dow Chemical, BASF and ICI Surfactants. Such surfactants are only limited to the extent that they are capable of being added to the composition for use in the system of this invention. The anionic surfactant which may be used in this invention includes at least one surfactant selected from the group consisting of a carboxylic acid salt, like a sodium and potassium salt of a straight-chain fatty acid, and a sulfonic acid salt, like a linear alkylbenzene sulfonate, and an α-olefin sulfonate, and a sulfuric acid ester salt, like a sulfated polyoxyethylenated straight-chain alcohol, and phosphoric and polyphosphoric acid esters, like a phosphated polyoxyethylenated alcohol or phenol. In such anionic surfactants, the carbon chain lengths may vary but often contain from about 5 to about 50 carbon atoms, and preferably, from about 5 to about 25 carbon atoms. A most preferred anionic surfactant which may be used in this invention includes, however, disodium laurimino dipropionate.

The cationic surfactant which may be used in the thickened liquid composition employed in this invention includes at least one surfactant selected from the group consisting of a quarternary ammonium compound with, for example, a halogen as the counterion. Examples include dodecyl trimethyl ammonium bromide, octadecyl trimethylammonium chloride (e.g., Arquad 18/50) and polyoxyethylenated long-chain amines.

The nonionic surfactant which may be used in the thickened liquid composition employed in the system of this invention include those selected from the group consisting of a polyoxyalkylenated alkylphenol, polyoxyalkylenated straight chain alcohol, amine oxide, polyoxyalkylenated polyoxyalkylene glycol, polyoxyalkylenated mercaptan, long-chain carboxylic acid ester, alkanolamine condensate and polyoxyalkylenated silicone. When the nonionic surfactants are derived from the condensation of ethyleneoxide with the product resulting from the reaction of propylene oxide and ethylene diamine products, they usually have about 40% to about 80% by weight polyoxyethylene and a molecular weight from about 5,000 to about 11,000. Others include amine oxides (cationic in a composition that is at a pH>7) such as bis-(2-hydroxyethyl) $C_{12-15}$ alkoxypropylamine oxide, sold under the name Tomah AO 728.

Regarding the zwitterionic surfactant which may be used in the thickened liquid composition employed in this invention, such a surfactant includes at least one surfactant selected from the group consisting of a β-N-alkylaminopropionic acid, N-alkyl-β-iminodipropionic acid, imidazoline carboxylate and betaines, like sulfobetaine.

The amphoteric surfactant which may be used in this invention includes those which are classified as derivatives of aliphatic secondary and tertiary amines in which the aliphatic radical can be straight or branched, and wherein one of the aliphatic substituents contains from about 8 to about 18 carbon atoms and one contains an anionic water solubilizing group, like a sulfonate. Illustrative examples of such amphoteric surfactants include sodium lauryl sarconsinate, dodecylamine and isethionate.

A more detailed description of the types of surfactants which may be used in this invention may be found in U.S. Pat. No. 5,120,532, the disclosure of which is incorporated herein by reference.

The thickening agent which may be used in this invention includes those which can be classified as cross-linked anionic polymers. Illustrative examples of these agents include Carbopol as made commercially available by B.F. Goodrich. Especially preferred thickening agents are Carbopol Aqua-30, as well as Carbopol 934 and 940. In addition to Carbopol, Accusol 820 is another thickening agent, classified as an acrylic acid, which may be used in the thickened liquid compositions of this invention. It is also within the scope of this invention for the surfactants themselves to act as thickening agents within the thickened liquid composition employed in the system of this invention. It is particularly noted that in a most preferred embodiment, the thickened liquid composition of the present invention does not comprise gum in order to ensure excellent cleaning results and minimal residue formation. Gum, as used herein, is defined to include natural and synthetic gums like those typically referred to as alginates, carrageenans, cellulose gels, and synthetic celluloses.

Regarding the surfactants, the thickened liquid composition that may be employed in the system of this invention typically comprise from about 0.01% to about 15.0% by weight surfactant, based on total weight of the composition and including all ranges subsumed therein. As to the thickening agent which may be used in the thickened liquid composition of this invention, such an agent typically make up from about 0.0 to about 10.0% by weight of the total weight of the thickened liquid composition, including all range subsumed therein.

The soil treating agent which may be used in the thickened liquid composition of the present invention includes acids like citric acid, hydrochloric acid, nitric sulfuric acid, sulfamic acid, glycolic acid, hydroxyethylene diphosphonic acid, and mixtures thereof. The bases which may be used typically include ammonia as well as any of the conventionally available metal hydroxides, like sodium hydroxide. The amount of soil treating agent that may be used in the thickened liquid compositions of the present invention is typically from about 0.1% to about 25.0%, and most preferably, from about 1.0% to about 10.0% by weight soil treating agent, based on total weight of the thickened liquid composition and including all ranges subsumed therein. Thus, it is within the scope of the invention for the thickened liquid composition to have a pH which is acidic, basic, or neutral.

It is also within the scope of the present invention to include within the thickened liquid composition of this invention an optional additive selected from the group consisting of a colorant, fragrance, organic solvent, builder hydrotrope, or chelator.

The colorant which may be used in this invention includes dyes and pigments. Such dyes and pigments are well known in the art and generally classified as azo- or diazo-colorants. As to the fragrance that may be used in this invention, such a fragrance includes any of the art recognized fragrances which may be used in a cleaning composition. The organic solvent which may be used typically includes ethers such as dipropylene glycol methyl ether which is sold by Dow Chemical under the name Dowanol DPM.

Within the thickened liquid composition employable in the present invention, it is not uncommon to use a hydrotrope such as sodium xylene sulfonate, calcium and ammonium xylene sulfonates, p-toluene sulfonate, and the like. The builder which may be used in this invention includes tetra sodium pyrophosphate, as well as sodium tripolyphosphate. The chelator which may be used in this invention includes EDTA and NTA.

The amount of each optional additive used in the thickened liquid composition of the present invention is typically from about 0.0 to about 10.0%, and preferably, from about 0.001% to about 8.0%, and most preferably, from about 0.002% to about 6.0% by weight, based on total weight of the thickened liquid composition and including all ranges subsumed therein.

Figure 2:
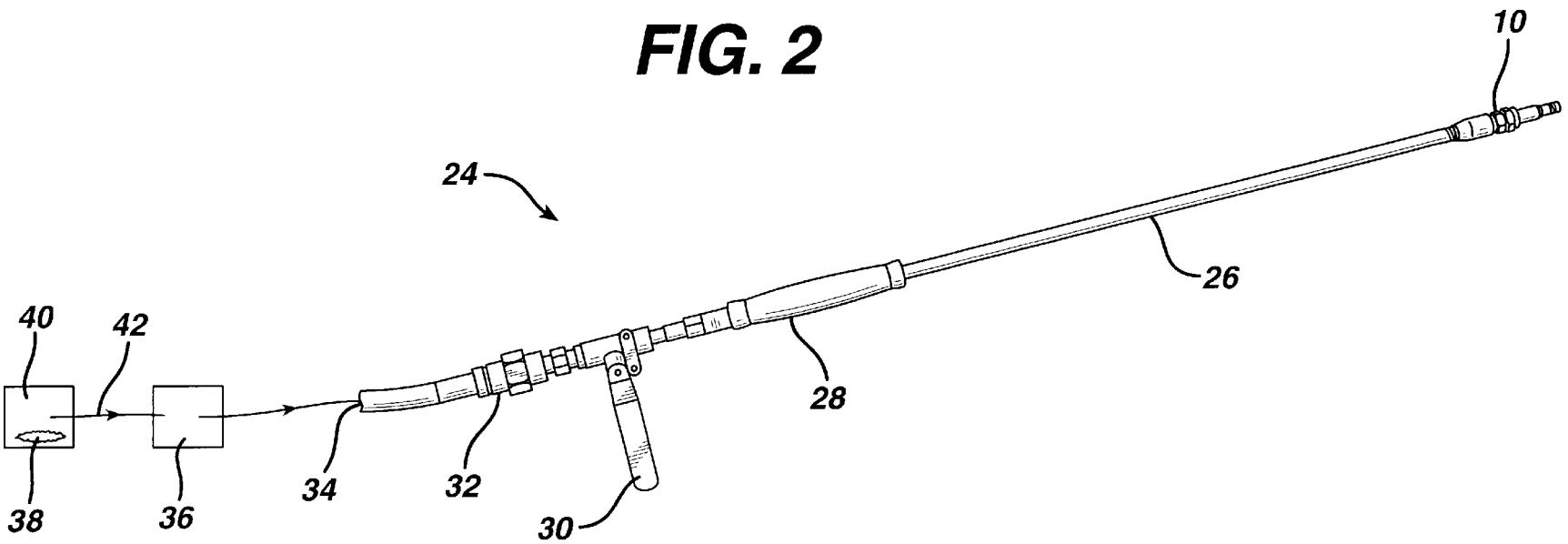
FIG. 2 is represents a type of spray wand which may be used in the system of this invention.

Turning to FIG. 1, the components of spray nozzle assembly 10, not assembled, are shown. The spray nozzle assembly 10 has an exit piece 12 with exit orifice 14 which allows the thickened liquid composition (not shown) of the system of this invention to exit from the spray nozzle assembly 10. The thickened liquid composition preferably exits at about 0.5 gallons per minute to about 6 gallons per minute, and preferably, from about 1.0 gallons per minute to about 3.0 gallons per minute, including all ranges subsumed therein. Retainer coupling 16 is the housing for orifice plate 18 having an orifice 20. The diameter of the orifice plate 18 is constant, but the diameter of the orifice 20 may vary, As previously mentioned, the orifice may have a diameter from about $2.0\times10^{-2}$ cm to about $6.5\times10^{-1}$ cm, and preferably, from about $7\times10^{-2}$ cm to about $5.0\times10^{-1}$ cm, and most preferably, from about $1.0\times10^{-1}$ cm to about $3.0\times10^{-1}$ cm, including all ranges subsumed therein. The spray nozzle assembly 10 also comprises a nozzle body 22 which is operayively connected to the retainer coupling 16 and wand 24 (i.e., spraying device) at wand rod 26 as shown in FIG. 2 so that the spray nozzle assembly 10 can be attached thereto.

The wand 24 may further comprise a hand grip 28, a shut off 30, as wello as a coupling means 32 to attach the wand 24 to a supply tube 34. Supply tube 34 is associated with pump 36 (e.g., pneumatic pump such as those made available by Aro, Benz Engineering, Inc; Yamada, and the Wilden Corporation) which pumps thickened liquid composition 38 out from container 40 via intake 42 and through wand 24.

When operating the system of the present invention, pump 36 supplies less than about 100 psi of pressure so that thickened liquid composition may be driven through exit orifice 14 to clean a soiled surface, not shown.

The following examples are provided to facilltate an understanding of the present invention. The examples are not intended to nlimit the scope of the claims.

EXAMPLE 1

| Thickened Alkaline Liquid | Weight Percent |
|---|---|
| Water | 76.995 |
| Sodium Gluconate granules | 1.00 |
| Liquid sodium hydroxide (50%) | 15.00 |
| Fluorescein Dye | 00.005 |
| Sodium Lauryl Ether Sulfate (60%)[1] | 3.00 |
| Tomah AO 728 special[2] | 4.00 |

[1]commercial sold as Steol CS-460, Witcolate SE-5, Sulfotex LMSE they are C12–14 sulfate ethoxylated with 3 moles EO.
[2]bis-(2-hydroxyethyl) C12–15 alkyloxypropylamine oxide

EXAMPLE 2

| Thickened Acid Liquid | Weight Percent |
|---|---|
| Water | 75.00 |
| Sulfamic acid | 12.00 |
| Glycolic acid | 3.00 |
| Monateric 1188M (30%) | 3.00 |
| Arquad 18/50 (50%)[3] | 4.00 |
| Sodium xylene sulfonate (45%)[4] | 3.00 |

[3]Arquad 18/50 is octadecyl trimethylammonium chloride (40–52%)
[4]Monateric 1188M is disodium laurimino dipropiionate (30%)

EXAMPLE 3

| Thickened (Non Caustic) Liquid | Weight Percent |
|---|---|
| Water | 65.55 |
| EDTA liquid (40%) | 5.00 |
| Accusol 445 (polyacrylic acid 47–50%) | 0.50 |
| TKPP liquid (30%) | 4.00 |
| Triethanolamine 99% | 5.00 |
| m-pyrol 0.95 | |
| Dowanol DPM | 8.00 |
| Monateric 1188M | 2.50 |
| Neodol 91-6 2.50 | |
| Carbopol Aqua-30 Polymer[5] | 6.00 |

[5]Carbopol Aqua 30 polymer is Aqueous Acrylate polymer emulsion.

The thickened liquid composition described in Examples 1–3 were made at room temperature with conventional stirring techniques. The thickened liquid compositions described in the examples all had a viscosity of about 150 cps at room temperature.

EXAMPLE 4

The soil was a mix of paper fibers, organic and inorganic fillers.

Cleaning Procedure:

An alkaline thickened liquid composition (as described in Example 1) was sprayed with the want and spray nozzle assembly described herein and powered by a conventional pneumatic pump on to a paper making machine. The spraying was accomplished with a nozzle design as described in the Figures and a thickened liquid composition was applied at 2 gpm at 60 psi delivery pressure. The exit orifice plate used for the trial was $2.8\times10^{-1}$ cm. The superior design of this system allowed for a consistent straight stream of thickened liquid composition with a fanning effect at the exit.

The thickened liquid composition was sprayed at the beginning from the section where the operator stood and moving towards the far end of the machine being cleaned (about 32 ft. away). The nozzle was oscillated by hand while aiming towards the machine. Thickened liquid composition was sprayed on the surface with two to three passes of the want. The entire surface (about 3,000 sq. ft.) was coated with the thickened liquid composition.

Immediately after the whole paper making machine was covered with the thickened liquid composition, the machine was rinsed with cold water sprayed via a conventional hose. An initial rinse with water created the machine foam that enhanced cleaning and removing of soil deposits on the machine.

The alkaline thickened liquid composition used was provided ready to use, and the composition had a viscosity of about 140 cps at room temperature. The soil targeted was paper making waste (e.g., paper fibers, organic and inorganic fillers). After about two (2) hours the surface was clean with at least 50.0% by weight less active than the amount of active used in conventional systems.

What is claimed is:

1. A system for cleaning an apparatus, the system comprising:

(a) a thickened liquid composition comprising a viscosity from about 50.0 cps to about 1,000 cps;

(b) a spraying device comprising at least one orifice having a diameter from about $2.0\times10^{-2}$ cm at about $6.5\times10^{-1}$ cm; and (c) a pressure source supplying less than about 100 psi of pressure wherein the thickened liquid composition comprises components that clean soil on the apparatus, and the thickened liquid composition exits the system at a flow rate of about 0.5 gallons per minute to about 6.0 gallons per minute.

2. The system according to claim 1 wherein the apparatus is a boiler, cooling tower, or food and beverage processing equipment.

3. The system according to claim 1 wherein the apparatus is a paper making machine.

4. The system according to claim 1 wherein the spraying device has at least one orifice having a diameter from about $1\times10^{-1}$ cm to about $3\times10^{-1}$ cm.

5. The system according to claim 1 wherein the pressure source is supplying a pressure from about 40 psi to about 80 psi.

6. The system according to claim 1 wherein the thickened liquid composition is basic, alkaline or non-caustic.

7. The system according to claim 1 wherein the thickened liquid composition comprises sodium lauryl ether sulfate, caustic and 2-bis-(2-hydroxyethyl) $C_{12-15}$ alkyloxypropylamine oxide, or an acid and octadecyl trimethylammonium chloride, or a chelating agent.

8. The system according to claim 1 wherein the system has an exit piece with a tapered portion prior to an exit orifice.

9. A method for cleaning an apparatus comprising the steps of:

(a) subjecting an apparatus to a system comprising:

(i) a thickened liquid composition comprising a viscosity from about 50.0 cps to about 1,000 cps;

(ii) a spraying device comprising at least one orifice having a diameter from about $2.0\times10^{-2}$ cm at about $6.5\times10^{-1}$ cm; and (iii) a pressure source supplying less than about 100 psi of pressure;

(b) contacting the apparatus with the thickened liquid composition; and (c) rinsing the apparatus wherein the thickened liquid composition comprises components that clean soil on the apparatus, and the thickened liquid composition exits the system at a flow rate of about 0.5 gallons per minute to about 6.0 gallons per minute.

10. A kit comprising:

(a) a thickened liquid composition comprising a viscosity from about 50.0 cps to about 1,000 cps, the liquid composition comprising components that clean soil on the apparatus;

(b) a spraying device comprising at least one orifice having a diameter from about $2.0\times10^{-2}$ cm at about $6.5\times10^{-1}$ cm; and (c) a pressure source supplying less than about 100 psi of pressure; and (d) instructions to use the liquid composition supplied as is, at a pressure that does not exceed about 100 psi, and at a flow rate of about 0.5 gallons per minute to about 6.0 gallons per minute.

* * * * *